US006761943B1

(12) United States Patent
Warner et al.

(10) Patent No.: US 6,761,943 B1
(45) Date of Patent: Jul. 13, 2004

(54) IMAGE RECEPTOR MEDIUM WITH HOT MELT LAYER, METHOD OF MAKING AND USING SAME

(75) Inventors: Elizabeth A. Warner, Minneapolis, MN (US); Steven R. Austin, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/503,286

(22) Filed: Feb. 14, 2000

Related U.S. Application Data

(63) Continuation-in-part of application No. 09/249,110, filed on Feb. 12, 1999, now abandoned.

(51) Int. Cl.[7] ..... B41M 5/40
(52) U.S. Cl. ..... 428/32.32; 428/32.34
(58) Field of Search ..... 428/195, 323, 428/500, 32.32, 32.34

(56) References Cited

U.S. PATENT DOCUMENTS

| | | | | | |
|---|---|---|---|---|---|
| 5,747,148 | A | | 5/1998 | Warner et al. | 428/212 |
| 5,789,342 | A | | 8/1998 | Evans et al. | 503/227 |
| 5,897,940 | A | * | 4/1999 | Malhotra et al. | 428/212 |
| 6,096,469 | A | * | 8/2000 | Anderson et al. | 430/119 |
| 6,110,601 | A | * | 8/2000 | Shaw-Klein et al. | 428/522 |
| 6,187,430 | B1 | * | 2/2001 | Mukoyoshi et al. | 428/331 |

FOREIGN PATENT DOCUMENTS

| | | | | |
|---|---|---|---|---|
| DE | 196 28 341 A1 | | 1/1998 | B41M/5/00 |
| EP | 0 199 874 | | 11/1986 | |
| EP | 0 736 392 | | 10/1996 | |
| EP | 0805049 | * | 11/1997 | B41M/3/12 |
| EP | 0826508 A1 | * | 3/1998 | B41M/5/00 |
| EP | 0 894 641 A2 | | 2/1999 | B41M/5/00 |
| GB | 2 147 003 | | 5/1985 | |
| WO | WO95/28285 | | 10/1995 | |
| WO | WO98/02314 | | 1/1998 | B41M/5/00 |
| WO | WO98/30749 | | 7/1998 | D06P/5/00 |
| WO | WO99/03685 | | 1/1999 | |
| WO | WO99/06219 | | 2/1999 | |
| WO | WO99/07558 | | 2/1999 | |

OTHER PUBLICATIONS

LUVICROSS: Versitile Specialty Polymers for technical applications; BASF Product Bulletin (1999); obtained from BASF website (www.basf.com). Site visited Dec. 2001.*

* cited by examiner

*Primary Examiner*—B. Shewareged

(57) ABSTRACT

An image receptor medium is disclosed as having a base medium, a hot melt layer adjacent to the base medium, and a porous imaging layer. An image may be imparted to the imaging layer, and heat and pressure may then be applied to the image receptor medium. A substantial number of the pores in the porous imaging layer are filled by the material of the hot melt layer, thereby fixing the image. The image receptor medium can be backed with an adhesive/release liner combination or mechanical fasteners to provide securing means or can be left without such means for "drop-in" backlit or other nonadhesive uses.

33 Claims, No Drawings

IMAGE RECEPTOR MEDIUM WITH HOT MELT LAYER, METHOD OF MAKING AND USING SAME

This application is a continuation-in-part of application Ser. No. 09/249,110, filed Feb. 12, 1999, now abandoned.

FIELD OF THE INVENTION

This invention relates to image receptor media for thermal or piezo inkjet printing wherein the media comprises a hot melt material.

BACKGROUND OF THE INVENTION

Image graphics are omnipresent in modem life. Images and data that warn, educate, entertain, advertise, etc. are applied on a variety of interior and exterior, vertical and horizontal surfaces. Nonlimiting examples of image graphics range from advertisements on walls or sides of trucks, posters that advertise the arrival of a new movie, warning signs near the edges of stairways.

The use of thermal and piezo inkjet inks have greatly increased in recent years with accelerated development of inexpensive and efficient inkjet printers, ink delivery systems, and the like.

Thermal inkjet hardware is commercially available from a number of multinational companies, including without limitation, Hewlett-Packard Corporation of Palo Alto, Calif., USA; Encad Corporation of San Diego, Calif., USA; Xerox Corporation of Rochester, N.Y., USA; LaserMaster Corporation of Eden Prairie, Minn., USA; and Mimaki Engineering Co., Ltd. of Tokyo, Japan. The number and variety of printers changes rapidly as printer makers are constantly improving their products for consumers. Printers are made both in desk-top size and wide format size depending on the size of the finished image graphic desired. Nonlimiting examples of popular commercial scale thermal inkjet printers are Encad's NovaJet Pro printers and H-P's 650C, 750C, and 2500CP printers. Nonlimiting examples of popular wide format thermal inkjet printers include H-P's DesignJet printers, where the 2500CP is preferred because it has 600×600 dots/inch (dpi) resolution with a drop size in the vicinity of about 40 picoliters.

3M markets Graphic Maker Inkjet software useful in converting digital images from the Internet, ClipArt, or Digital Camera sources into signals to thermal inkjet printers to print such image graphics.

Inkjet inks are also commercially available from a number of multinational companies, particularly 3M which markets its Series 8551; 8552; 8553; and 8554 pigmented inkjet inks. The use of four principal colors: cyan, magenta, yellow, and black (generally abbreviated "CMYK") permit the formation of as many as 256 colors or more in the digital image.

Media for inkjet printers are also undergoing accelerated development. Because inkjet imaging techniques have become vastly popular in commercial and consumer applications, the ability to use a personal computer to digitally print a color image on paper or other receptor media has extended from dye-based inks to pigment-based inks. And the media must accommodate that change. Pigment-based inks provide more durable images because pigment particles are contained in a dispersion before being dispensed using a thermal inkjet print head.

Inkjet printers have come into general use for wide-format electronic printing for applications such as, engineering and architectural drawings. Because of the simplicity of operation and economy of inkjet printers, this image process holds a superior growth potential promise for the printing industry to produce wide format, image on demand, presentation quality graphics.

Therefore, the components of an inkjet system used for making graphics can be grouped into three major categories:

1 Computer, software, printer.

2 Ink.

3 Receptor medium.

The computer, software, and printer will control the size, number and placement of the ink drops and will transport the receptor medium through the printer. The ink will contain the colorant which forms the image and carrier for that colorant. The receptor medium provides the repository which accepts and holds the ink. The quality of the inkjet image is a function of the total system. However, the composition and interaction between the ink and receptor medium is most important in an inkjet system.

Image quality is what the viewing public and paying customers will want and demand to see. From the producer of the image graphic, many other obscure demands are also placed on the inkjet media/ink system from the print shop. Also, exposure to the environment can place additional demands on the media and ink (depending on the application of the graphic). Most common, durability of the image graphic is required in humid indoor or outdoor environments, especially locations capable of being soaked with rain or melting snow or ice.

Current inkjet receptor media are direct coated with a dual layer receptor medium according to the disclosure contained in U.S. Pat. No. 5,747,148 (Warner et al.) and are marketed by 3M under the brands 3M™ Scotchcal™ Opaque Imaging Media 3657-10 and 3M™ Scotchcal™ Translucent Imaging Media 3637-20. Other products marketed by 3M include Nos. 8522CP and 8544CP Imaging Media, the former having a coating on the imaging surface for controlling dot gain and the latter having a pigment management system and a fluid management system in pores of the membrane. With the rapid rise in usage of inkjet printing systems to create wide format graphics having digitally-produced images thereon, more and better inkjet receptor media are needed, especially those which rise to the level of precision and lighting requirements that are used for photographically-created image graphics.

These media have coatings provided by water-borne systems, either for entirely water-soluble or water-dispersible ingredients. Water-soluble ingredients are susceptible to loss of durability of the image graphic when encountering humid or wet environments. Most often, the image is created by printing of a water-based ink needs to be fixed to prevent ink migration and loss of precision of the image graphic. Water-dispersible ingredients are particularly difficult to handle during manufacturing to provide reproducible image receptive layers on substrates; working with emulsion-based delivery of coatings introduces a number of additional manufacturing factors that can affect efficiency and productivity.

SUMMARY OF INVENTION

An image receptor medium, comprising a base medium having a hot melt layer on one major surface. The hot melt layer has a melting temperature between 40 and 150° C. An imaging layer lies atop the hot melt layer, wherein the imaging layer comprises a water-insoluble porous coating adapted to imbibe ink.

A method of preparing an imaging layer is also provided, a) applying a hot-melt layer to a base medium on one major surface thereon, b) applying a coating formulation to said hot-melt layer; and c) evaporating solvent to form the imaging layer.

A method of fixing an image graphic is also provided, which comprises providing the image receptor medium as described above, imparting an image to the medium by printing with an inkjet ink. Heat and pressure are then applied to the imaged graphic, thereby filling a substantial portion of pores in said porous coating with hot melt material.

DETAILED DESCRIPTION

The present invention provides significant advantages as compared to prior art techniques providing a simple overlaminate to protect an image. Because the present medium incorporates a hot melt layer under the porous imaging layer, it is possible to fix the image using only the single sheet material without the need for use of a second sheet. This saves considerable resources, because there is no need for a second liner or carrier material to assist in delivery of an overlaminate. Also, the operator does not need to undertake the extra handling steps for a second material such as the effort required to obtain alignment, trimming, thread-up and other special handling requirements. Because one aspect of the present invention makes it possible to avoid the use of an overlaminate, the final image of the product may be clear to the observer. The present medium and method provides an economical material for use in outdoor or harsh conditions not previously thought possible without a separate protective overlaminate or other extraordinary or expensive techniques.

This invention has utility for the production of image graphics using wide format inkjet printers and pigment-based ink. This invention solves the problem of obtaining precise digitally-produced image graphics that are capable of enduring water-laden environments that would otherwise cause the image graphic to lose precision.

The hot-melt layer containing articles and processes are useful because they provide a method by which a fabricator can print a graphic using ink jet printing, and then impart heat and pressure to the material (potentially with or preferably without the use of a hot-melt overlaminate) to encapsulate the image. After fixing, the image is water-fast and protected from the elements and could be put outside even without any special ink fixing chemistry. The encapsulation of the coating, which involves filling the pores, makes the coating and therefore the resultant image much tougher, more water resistant, and potentially more UV-resistant.

Base Medium

The base medium useful for the present invention can be any polymeric material that can be uniformly coated by a water insoluble coating formulation to generate an inkjet receptor medium of the present invention. The base medium can be solid, porous, or microporous. The base medium can be transparent, clear, translucent, colored, non-colored, or opaque, or a combination thereof, as required by those creating the image graphic.

The base medium preferably can have a thickness ranging from about 25 microns to about 750 microns and more preferably from about 50 microns to about 250 microns.

The base medium can be rigid, flexible, elastic, or otherwise, again as required by those creating the image graphic.

Nonlimiting examples of polymers useful in the creation of the base medium include polyolefins, polyurethanes, polyesters, acrylics, polycarbonates, polyvinyl chlorides and other vinyl polymers and copolymers, polystyrenes. Presently preferred is a polyester film in the range of thickness from about 110 to about 180 $\mu$m thickness due to low cost and handling.

The size of the base medium is only limited by the capacity of the printer through which the medium can pass for printing. Printers directed to personal or business usage are usually small-format, i.e., less than about 56 cm printing width, whereas printers directed to commercial or industrial usage are usually large-format, i.e., greater than that printing width of 56 cm. As the digital revolution in image graphics continues to occur, many more uses of inkjet printers will be found, especially for those industries that distribute an image to many locations before printing it.

Hot Melt Layer

The hot melt layer is selected from solid polymeric materials which soften at elevated temperatures to enable them to flow and fill void volumes in the adjacent porous imaging layer. These hot melt materials may comprise any thermoplastic polymeric composition having appropriate thermal response properties and may be selected from many polymer classes including, but not limited to, polyamides, polyacrylates, polyolefins, polystyrenes, polyvinyl resins, and copolymers and blends of these and other polymers. U.S. Pat. No. 4,656,114 shows many useful thermal adhesives that would be appropriate in the practice of the present invention. The preferred hot melt materials have melting temperatures between 90° C. and 120° C.

Other non-limiting examples include ethylene vinyl acetate copolymers, polyesters, polyester-amides, polyurethanes and thermoplastic elastomers. Optionally or as needed, the hot melt material may also contain additives such as polybutylenes and phthalates as non-limiting examples of plasticizers, antioxidants such as hindered phenols and tackifiers such as rosin derivatives.

Imaging Layer

The present imaging layer is a water-insoluble porous coating material. Preferably, the void volume of the pores is 20% to 80% of the dried imaging layer volume. More preferably, the void volume of the pores is 30% to 60% of the dried imaging layer volume. Void volume is evaluated by any appropriate means in the art, such as imbibing the image layer with a liquid material to determine the volume available for such liquid, estimation using photomicrographs or other visual techniques, or calculation by determining overall volume and subtracting actual image layer volume by density determination. An example of an evaluation technique is mercury pore symmetry. Preferably, the porous imaging layer comprises a binder that further comprises particulates having a mean particle size of about 1 $\mu$m to about 25 $\mu$m and preferably from about 4 $\mu$m to about 15 $\mu$m.

A porous coating layer may be formed from, for example, the evaporation of solvent from a solvent-containing coating formulation comprising binder and particulates, leaving a disorganized collection of particulates bound by the binder. The pores are able to quickly imbibe the ink, providing a quick drying medium. This porous structure may be facilitated by the use of particulates that are irregular in shape (e.g. non-spherical). The imaging layer is not unlike the popular confection of "peanut brittle" with the binder holding together the particulate "peanuts" and enormous porosity in the binder "brittle" formed by solvent evaporation.

Binder

Preferred binders for the present invention imaging layer have low cost, easy manufacturing and processing features, and can form tough layers on base media described above, with or without the use of a priming layer between the imaging layer and the base medium. These are water-insoluble, and binders are preferably soluble in the solvent used for the coating formulation to assure even delivery of the coating to the base medium. Alternatively, the coating formulation may be in the form of a latex dispersion. This is particularly desirable in the case of systems that do not contain a multivalent cationic salt, which would tend to adversely affect the latex dispersion.

Nonlimiting examples of binders include acrylic acid copolymer, poly(meth)acrylates, polyvinyl acetals (such as polyvinyl butyral and polyvinyl formal) vinyl acetate copolymers, polyurethanes, vinyl chloride polymers and copolymers such as VYNS (a copolymer of vinyl chloride and vinyl acetate from Union Carbide of Danbury, Conn., USA), VAGH (a terpolymer of vinyl chloride, vinyl acetate and vinyl alcohol from Union Carbide of Danbury, Conn., USA) and the like known to those skilled in the art for producing high quality, low cost layers in laminate constructions. These binders are readily commercially available as resins from large and small manufacturers. Particularly preferred as binders for the present invention include Paraloid B82 brand methyl methyacrylate polymer from Rohm and Haas of Philadelphia, Pa., USA; and VYHH (a copolymer of vinyl chloride and vinyl acetate from Union Carbide of Danbury, Conn., USA).

The amount of binder that can be used in the coating solution for coating the base medium range from about 10% to about 50% and preferably from about 20% to about 40% weight percent of the total coating solids.

Particulate

The coating formulation optionally includes particulates in an amount and size sufficient to assist in providing a porous structure in the ultimate imaging layer. Additionally, the particles may provide surface variation and protection of the pigment-based particles delivered in the inkjet inks for the final product. Nonlimiting examples of particulates include those disclosed in the prior art such as starch, silica, zeolites, clay particles, insoluble silicates, such as calcium silicate, alumina, talc, titanium dioxide and the like. The particulates need to be insoluble in the solvents used in the coating formulations. Moreover, it has been found in this invention that a crosslinked polyvinylpyrrolidone particle is particularly useful for providing a good image when printed with both pigment or dye-based aqueous ink jet inks. It is also an advantage that a receptor medium such as described, while primarily of use in receiving pigment-based ink jet inks to give a water-fast fade-resistant image, can also optionally be used to print with dye-based inks. Such crosslinked polyvinylpyrrolidone particles are commercially available from a number of sources in a number of particle size distributions, including BASF of Wyandotte, Mich., USA under the Luvicross® M brand.

When a crosslinked polyvinylpyrrolidone particulate is used with a binder and a solvent-soluble multivalent cationic salt in the coating formulation, the amount of particulate to be used is determined by its weight/weight ratio with the binder. The particulate:binder W/W (weight/weight) ratio can range from about 1:1 to about 9:1 and preferably from about 1.7:1 to about 2.0:1 and most preferably about 1.8:1. Other particulates may require a different W/W ratio with the binder because it is really the V/V (volume/volume) ratio that concerns the imaging layer after the solvent has evaporated for the binder to hold the particulates in place adequately.

Optional Solvent-soluble Multivalent Cationic Salts

Solvent-soluble multivalent cationic salts are preferably used in the present invention to inhibit ink migration on an imaging layer in the presence of water, where the imaging layer is water-insoluble. These cationic salts interact with the pigment particles of the ink to fix such pigment particles within the porous imaging layer.

Nonlimiting examples of solvent-soluble multivalent cationic salts include those salts composed of cations selected from the group consisting of zinc, aluminum, calcium, magnesium, chromium, and manganese and anions selected from the group consisting of chloride, bromide, iodide, and nitrate.

Preferred examples of such salts include anhydrous zinc bromide and anhydrous calcium chloride.

The amount of salts that can be used in the coating solution for coating the base medium range from about 0.1% to about 10% and preferably from about 0.75% to about 3% weight percent of the solids of the coating formulation.

Optional Priming Layer

Depending on the type of base medium, to provide an excellent surface for the imaging layer, a priming layer can be provided between the base medium and the hot melt layer delivered by the solvent-based system. Nonlimiting examples of such priming layers include poly(vinylidene chloride) or solvent-adhesion primers such as found on Mitsubishi Diafoil 4507 brand polyester (available from Mitsubishi Polyester Film, 2001 Hood Road, P.O. Box 1400, Greer, S.C. 29652).

Alternatively or in addition to priming the base medium, surface alteration treatments can be used to enhance adhesion to the base film such as corona treatment, surface ablation, surface abrasion, and the like known to those skilled in the art.

Optional Adhesive Layer and Optional Release Liner

The receptor medium optionally has an adhesive layer on the opposite major surface of the base medium that is optionally but preferably protected by a release liner. After imaging, the image receptor medium can be adhered to a horizontal or vertical, interior or exterior surface to warn, educate, entertain, advertise, etc.

The choice of adhesive and release liner depends on usage desired for the image graphic.

Pressure sensitive adhesives can be any conventional pressure sensitive adhesive that adheres to both membrane and to the surface of the item upon which the inkjet receptor medium having the permanent, precise image is destined to be placed. Pressure sensitive adhesives are generally described in Satas, Ed., *Handbook of Pressure Sensitive Adhesives* 2nd Ed. (Von Nostrand Reinhold 1989), the disclosure of which is incorporated by reference. Pressure sensitive adhesives are commercially available from a number of sources. Particularly preferred are acrylate pressure sensitive adhesives commercially available from Minnesota Mining and Manufacturing Company of St. Paul, Minn. and generally described in U.S. Pat. Nos. 5,141,790, 4,65,592, 5,045,386, and 5,229,207 and EPO Patent Publication EP 0 570 515 B1 (Steelman et al.) Another suitable adhesive is disclosed in U.S. patent application Ser. No. 08/775,844, now U.S. Pat. No. 6,197,397, the disclosure of which is incorporated by reference.

Release liners are also well known and commercially available from a number of sources. Nonlimiting examples of release liners include silicone coated kraft paper, silicone coated polyethylene coated paper, silicone coated or non-coated polymeric materials such as polyethylene or polypropylene, as well as the aforementioned base materials coated with polymeric release agents such as silicone urea, urethanes, and long chain alkyl acrylates, such as defined in U.S. Pat. Nos. 3,957,724; 4,567,073; 4,313,988; 3,997,702; 4,614,667; 5,202,190; and 5,290,615; the disclosures of which are incorporated by reference herein and those liners commercially available as Polyslik brand liners from Rexam Release of Oakbrook, Ill., USA and EXHERE brand liners from P. H. Glatfelter Company of Spring Grove, Pa., USA.

Alternatively, one can provide mechanical fasteners on the opposing surface as disclosed in copending, coassigned, U.S. patent application Ser. No. 08/930,957, the disclosure of which is incorporated by reference.

When used in a "drop-in" backlit condition, the inkjet receptor medium has no adhesive or mechanical fasteners on the opposing major surface of the medium, although adhesives and fasteners can be limited to perimeter regions of the medium to secure the imaged medium to supporting rigid sheets. The translucent coating applied to a transparent or translucent receptor medium can also be used in second surface applications, for example by affixing the imaged graphic on the inside of a transparent viewing surface such as a window or the plastic front of a lightbox, vending machine etc. using a transparent double-sided sheet adhesive such as 8560 application adhesive (available from 3M Commercial Graphics Division, 3M Center, Maplewood, Minn. 55144-1000).

Optional Additives

Optional additives to the imaging layer could include coparticulates such as silica or titanium dioxide to increase optical opacity. Such coparticulates may optionally be less than 1 μm, and preferably between about 10 and about 100 nanometers in size. Also optionally added are UV and/or heat stabilizers such as hindered amine light stabilizers (HALS), UV absorbers, antioxidants and heat-stabilizers. Such additives are well known in the art and are available from companies such as Ciba Geigy Additives (7 Skyline Drive, Hawthorne, N.Y. 10532-2188), Cytec Industries Inc. (P.O. Box 426, Westmont, Ill. 60559-0426), Sandoz (4000 Monroe Road, Charlotte, N.C. 28205) or BASF (BASF Aktiengesellschaft Farbmittel und Prozeβchemikalien, 67056 Ludwigshafen, Germany). Other additives could include cobinders, plasticizers for the binders present, and surfactants.

Preparation of the Coating Formulation and Delivery to the Base Medium

The coating formulation is solvent-based and uncomplicated to prepare because the various ingredients except the particulate are preferably soluble in the solvent chosen. For purposes of the present invention, a "solvent based coating formulation" is a formulation wherein the majority of the materials present in the formulation that are liquid at room temperature are organic materials. Such formulations may additionally comprise water in smaller proportions. Preferably, the solvent based coating formulation comprises less than 30% water, more preferably less than 20% water, and most preferably less than 10% water. The coating formulation should be thoroughly mixed and the resulting dispersion screened to assure an appropriate size of particulate for the wet coating weight desired for the formation of the imaging layer. The coating formulation is preferably shelf stable, so that it does not form a non-reversible agglomeration during the expected duration between preparation of the coating formulation and application to an intended non-porous base medium.

The coating formulation can be applied in a thickness to the base medium depending on the amount of ink likely to be printed on the inkjet receptor medium. Preferably, the solvent based coating formulation has a wet coating thickness from about 50 μm to about 500 μm, and preferably from about 152 μm (6 mils) to about 200 μm (8 mils) when the solution is approximately 32.5% solids (weight solids to weight of solution) and the particulate is Luvicross® M and the binder is Paraloid B82 and the weight ratio of particulate to the binder 1.8.

The imaging layer preferably has a dry coating weight ranging from about 20 g/m$^2$ to about 80 g/m$^2$ and preferably from about 25 g/m$^2$ to about 60 g/m$^2$. The hot-melt layer can be between about 10% and 200% of the thickness of the imaging layer, and is preferably 30% to 75% and more preferably 40% to 60% the thickness of the imaging layer.

This present invention is particularly useful for protecting images made by printing with dye-based inks. When the optional particulates are present in the imaging layer and the solvent has evaporated, an inherent porosity has been formed. This porosity can be collapsed through the use of heat and pressure to encapsulate the image in the location where it was printed when an adjacent heat-processable layer is present. This encapsulation provides a permanent ink fixing.

In use, the image receptor medium as described above is imaged using, for example, a thermal or piezo inkjet ink. Heat and pressure is then applied to the imaged graphic, hereby filling a substantial portion of pores in the porous coating with hot melt material. Any appropriate mechanism may be used to apply heat and pressure, for example passing the imaged graphic through a hot nip. Most preferably, the imaged graphic is passed through a laminator such as is widely used in many print shops today. Preferably, the laminator imparts heat and pressure at a temperature between about 65° C. to 180° C., more preferably between about 100° C. to 120° C., and most preferably between about 110° C. to 115° C.

What is claimed is:

1. An image receptor medium, comprising:

a base medium having a major surface a) a hot melt layer permanently attached to said major surface of said base medium, said hot melt layer having a melting temperature between 40 and 150° C., and b) an imaging layer atop said hot melt layer and permanently attached thereto, said imaging layer (i) comprising a water-insoluble porous coating capable of imbibing ink, wherein the porous coating comprises water insoluble binder and particulates having a mean particle size of from about 1 μm to about 25 μm, and (ii) having a pore void volume of 20% to 80% of a dried imaging layer volume.

2. The medium of claim 1, wherein the hot melt layer has a melting temperature between 90 and 120° C.

3. The medium of claim 1, wherein the particulates are crosslinked poly(vinyl pyrrolidone) particulates.

4. The medium of claim 1, wherein the binder is selected from the group consisting of acrylic acid copolymers, poly (meth)acrylates, vinyl acetate copolymers, polyvinyl acetals, polyurethanes, vinyl chloride polymers and copolymers and combinations thereof.

5. The medium of claim 1, wherein the porous coating has a wet coating thickness from about 50 μm to about 500 μm.

6. The medium of claim 1, wherein the dry coating weight of the imaging layer ranges from about 20 $g/m^2$ to about 80 $g/m^2$.

7. The medium of claim 1, wherein the hot melt layer is selected from the group consisting of polyamides, polyacrylates, polyolefins, polystyrenes, polyvinyl resins, and copolymers and blends of these.

8. The medium of claim 1, wherein the imaging layer further comprises an organic-solvent soluble multivalent cationic salt.

9. The medium of claim 8, wherein said organic-solvent soluble multivalent cationic salt is composed of a cation selected from the group consisting of zinc, aluminum, calcium, magnesium, chromium, and manganese and an anion selected from the group consisting of chloride, bromide, iodide, and nitrate.

10. The medium of claim 1, further comprising a pressure sensitive adhesive layer on an opposing major surface of the base medium opposite said permanently attached hot melt layer.

11. The medium of claim 1, further comprising a mechanical fastener on an opposing major surface of the base medium opposite said permanently attached hot melt layer.

12. The medium of claim 1, wherein the hot melt layer consists essentially of:

(i) one or more hot melt materials selected from the group consisting of polyamides; polyacrylates; polyolefins; polystyrenes; polyvinyl resins; ethylene vinyl acetate copolymers; polyesters; polyester-amides; polyurethanes; thermoplastic elastomers; and copolymers of monomers forming polyamides, polyacrylates, polyolefins, polystyrenes, and polyvinyl resins; and optionally (ii) one or more additives selected from the group consisting of polybutylenes, phthalates, hindered phenols, and tackifiers.

13. The medium of claim 1, wherein the base medium comprises a polyester film having a film thickness from 110 $\mu$m to 180 $\mu$m.

14. The medium of claim 1, wherein the binder is present in an amount ranging from 10 to 50 weight percent, based on a total weight of the imaging layer.

15. The medium of claim 8, wherein the organic-solvent multivalent cationic salt is present in an amount ranging from 0.1 to 10.0 weight percent based on a total weight of the imaging layer.

16. The medium of claim 8, wherein the organic-solvent multivalent cationic salt comprises anhydrous zinc bromide or anhydrous calcium chloride.

17. The medium of claim 1, wherein the base medium includes a base layer and a primer layer on the base layer, wherein the primer layer defines the one major surface of the base medium.

18. The medium of claim 1, wherein the imaging layer consists essentially of:

a) water insoluble polymeric binder;

b) particles selected from the group consisting of starch, silica, zeolites, clay particles, insoluble silicate, calcium silicate, alumina, talc, titanium dioxide, crosslinked polyvinylpyrrolidone particles, and a combination thereof; and optionally c) organic-solvent soluble multivalent cationic salt; and d) one or more additives selected from the group consisting of silica, titanium dioxide, a UV stabilizer, a heat stabilizer, a hindered amine light stabilizer, a UV absorber, an antioxidant, plasticizers, and surfactants.

19. An image receptor medium comprising:

a base medium having at least one major surface a) a hot melt layer permanently attached to said one major surface of said base medium, said hot melt layer having a melting temperature between 40 and 150° C. and consists essentially of:

(i) one or more hot melt materials selected from the group consisting of polyamides; polyacrylates; polyolefins; polystyrenes; polyvinyl resins; ethylene vinyl acetate copolymers; polyesters; polyester-amides; polyurethanes; thermoplastic elastomers; and copolymers of monomers forming polyamides, polyacrylates, polyolefins, polystyrenes, and polyvinyl resins; and optionally (ii) one or more additives selected from the group consisting of polybutylenes, phthalates, hindered phenols, and tackifiers, and b) an imaging layer atop said hot melt layer and permanently attached thereto, said imaging layer comprising a water-insoluble porous coating capable of imbibing ink.

20. The medium of claim 19, wherein the imaging layer consists essentially of:

a) water insoluble polymeric binder;

b) particles selected from the group consisting of starch, silica, zeolites, clay particles, insoluble silicate, calcium silicate, alumina, talc, titanium dioxide, crosslinked polyvinylpyrrolidone particles, and a combination thereof; and optionally c) organic-solvent soluble multivalent cationic salt; and d) one or more additives selected from the group consisting of silica, titanium dioxide, a UV stabilizer, a heat stabilizer, a hindered amine light stabilizer, a UV absorber, an antioxidant, plasticizers, and surfactants.

21. The medium of claim 20, wherein the imaging layer contains an organic-solvent soluble multivalent cationic salt comprising an organic-solvent soluble multivalent cationic salt composed of a cation selected from the group consisting of zinc, aluminum, calcium, magnesium, chromium, and manganese and an anion selected from the group consisting of chloride, bromide, iodide, and nitrate.

22. The medium of claim 20, wherein the particles are crosslinked poly (vinyl pyrrolidone) particulates.

23. The medium of claim 1, wherein the particulates have a mean particle size of from about 4 $\mu$m to about 15 $\mu$m.

24. The medium of claim 3, wherein the particulate and binder are present in a particulate:binder weight ratio of from about 1:1 to about 9:1.

25. The medium of claim 3, wherein the particulate and binder are present in a particulate:binder weight ratio of from about 1.7:1 to about 2.0:1.

26. The medium of claim 3, wherein the particulate and binder are present in a particulate:binder weight ratio of about 1.8:1.

27. The medium of claim 3, wherein the binder comprises methyl methacrylate polymer.

28. The medium of claim 27, wherein the particulate and binder are present in a particulate:binder weight ratio of about 1.8:1.

29. The medium of claim 1, wherein the imaging layer has a pore void volume of 30% to 60%.

30. An image receptor medium comprising:

a base medium having a major surface;

a hot melt layer on said major surface of said base medium, said hot melt layer having a melting temperature between 40 and 150° C., and an imaging layer atop said hot melt layer and permanently attached thereto, said imaging layer (i) comprising a water-insoluble porous coating capable of imbibing ink, and (ii) having a pore void volume of 20% to 80% of a dried imaging layer volume.

31. The medium of claim 30, wherein the imaging layer comprises water insoluble binder and particulates having a mean particle size of from about 1 $\mu$m to about 25 $\mu$m.

32. The medium of claim 30, further comprising a pressure sensitive adhesive layer on an opposing major surface of the base medium opposite said hot melt layer.

33. The medium of claim 30, wherein the hot melt layer comprises one or more hot melt materials selected from the group consisting of polyamides; polyacrylates; polyolefins; polystyrenes; polyvinyl resins; ethylene vinyl acetate copolymers; polyesters; polyester-amides; polyurethanes; thermoplastic elastomers; and copolymers of monomers forming polyamides, polyacrylates, polyolefins, polystyrenes, and polyvinyl resins.

* * * * *

UNITED STATES PATENT AND TRADEMARK OFFICE

CERTIFICATE OF CORRECTION

PATENT NO. : 6,761,943 B1
DATED : July 13, 2004
INVENTOR(S) : Warner, Elizabeth A.

It is certified that error appears in the above-identified patent and that said Letters Patent is hereby corrected as shown below:

Title page,
Item [56], References Cited, U.S. PATENT DOCUMENTS, delete "8/2000" and insert in place thereof -- 1/2000 --.
OTHER PUBLICATIONS, delete "LUVICROSS: Versitile" and insert in place thereof -- LUVICROSS®: Versatile --.

Column 1,
Line 15, delete "modem" and insert in place thereof -- modern --.

Column 6,
Line 54, after "Adhesives" insert -- , --.
Line 60, delete "4,65,592" and insert in place thereof -- 4,605,592 --.
Line 62, insert -- . -- before "Another".
Line 63, after "in" insert -- copending, coassigned, --.

Column 7,
Line 42, delete "Ciba Geigy" and insert in place thereof -- Ciba-Geigy --.

Column 8,
Line 14, after "binder" insert -- is --.
Line 14, delete "1.8" and insert in place thereof -- 1.8:1 --.

Signed and Sealed this

Twenty-sixth Day of October, 2004

JON W. DUDAS
*Director of the United States Patent and Trademark Office*